US011633845B2

(12) United States Patent
Wu

(10) Patent No.: US 11,633,845 B2
(45) Date of Patent: Apr. 25, 2023

(54) POWER MACHINE TOOL

(71) Applicant: MATATAKITOYO TOOL CO., LTD., Taichung (TW)

(72) Inventor: Yi-Min Wu, Taichung (TW)

(73) Assignee: MATATAKITOYO TOOL CO., LTD., Taichung (TW)

( * ) Notice: Subject to any disclaimer, the term of this patent is extended or adjusted under 35 U.S.C. 154(b) by 65 days.

(21) Appl. No.: 17/367,610

(22) Filed: Jul. 5, 2021

(65) Prior Publication Data

US 2023/0001560 A1 Jan. 5, 2023

(51) Int. Cl.

| | |
|---|---|
| ***B25F 5/00*** | (2006.01) |
| ***B25F 5/02*** | (2006.01) |
| ***B25B 21/00*** | (2006.01) |

(52) U.S. Cl.

CPC ..... *B25F 5/001* (2013.01); *B25B 21/004* (2013.01); *B25F 5/025* (2013.01)

(58) Field of Classification Search

CPC ..... B25F 5/025; B25F 5/001; B25B 21/004
See application file for complete search history.

(56) References Cited

U.S. PATENT DOCUMENTS

| | | | | |
|---|---|---|---|---|
| 4,375,047 | A * | 2/1983 | Nelson | G01N 11/14 73/54.35 |
| 5,136,197 | A * | 8/1992 | Hallett | B23B 45/02 310/78 |
| 9,475,180 | B2 | 10/2016 | Eshleman et al. | |
| 2002/0134172 | A1 | 9/2002 | Yamada et al. | |
| 2009/0064824 | A1 | 3/2009 | Tsuyoshi et al. | |
| 2011/0232930 | A1 | 9/2011 | Zhang et al. | |
| 2017/0216999 | A1 | 8/2017 | Cheng | |
| 2019/0283222 | A1 | 9/2019 | Thorson et al. | |
| 2021/0016420 | A1 | 1/2021 | Kumagai et al. | |

FOREIGN PATENT DOCUMENTS

| | | | |
|---|---|---|---|
| CN | 201201207 | Y | 3/2009 |
| CN | 105291032 | A | 2/2016 |
| EP | 1208946 | B1 | 2/2006 |
| JP | 4138913 | B2 | 8/2008 |
| JP | 4659862 | B2 | 3/2011 |
| TW | M444913 | U | 1/2013 |
| WO | 2018054311 | A1 | 3/2018 |
| WO | 2021065172 | A1 | 4/2021 |

OTHER PUBLICATIONS

Search Report dated Dec. 3, 2021 of the corresponding European patent application No. EP21184026.9.
Office Action dated Aug. 16, 2022 of the corresponding Japan patent application No. 2021-112911.
Office Action dated Apr. 19, 2022 of the corresponding Taiwan patent application No. 110119641.

* cited by examiner

*Primary Examiner* — Daniel Jeremy Leeds
(74) *Attorney, Agent, or Firm* — Chun-Ming Shih; HDLS IPR Services

(57) ABSTRACT

A power machine tool (1) of the present disclosure includes a housing (10) and a control board (20), a power device (30), a bearing set (40), a transmission mechanism (50) and a torque axle (60) disposed in the housing (10). The power device (30) is disposed in the housing (10) via the bearing set (40) and transmits a torque via the transmission mechanism (50). The torque axle (60) is connected to a rear side of the power device (30) and rotates with the power device (30). In addition, a torque sensor (2) is arranged on the rear side of the power device (30) to detect the torque of the power machine tool.

9 Claims, 4 Drawing Sheets

POWER MACHINE TOOL

BACKGROUND

Technical Field

The technical field of the present disclosure relates to a power tool, and in particular, to a power machine tool and a torque display structure thereof.

Description of Related Art

For a related-art power tool, such as electric screwdriver and impact wrench, etc., its structure mainly includes a housing, a power device (such as battery or pressurized air), a transmission mechanism and a control element, etc. In addition, the power device is secured inside the housing and the rotating axle is connected to the transmission mechanism, and the control element is electrically connected to the power device. Accordingly, the control element is used to control the running of the power device to drive the transmission mechanism and the tool head installed on the transmission mechanism, thereby providing sufficient torque to allow the tool head to rotate.

However, the related-art power tools are torque adjustable devices, and such power tools often continue to rotate after exceeding the predefined torques, leading to the situations of damaged components and reduced useful life of the power tools. Accordingly, there is a need for improvement of such situations.

Furthermore, most of the related-art power tools are installed with torque sensors to detect the torques. In addition, when the predefined torque is reached, a signal is transmitted to the control element to control the power device to stop running. Moreover, the torque sensors of related-art power tools are arranged on the transmission mechanism, and such torque sensors are constantly under the rotational state as they rotate with the running of the transmission mechanism. Consequently, the drawbacks of rupture of cables or improper electrical contact often occur and the electrical connection is affected, leading to damages of the power tool. In addition, during the operation of a power tool, the transmission mechanism connecting to the tool head is also subject to vibration and deformation, such that the torque value detected by the torque sensor arranged on the power tool is affected, thereby reducing the accuracy of the torque sensor.

In view of the above, the inventor seeks to overcome the aforementioned drawbacks associated with the current technology and aims to provide an effective solution through extensive researches along with utilization of academic principles and knowledge.

Summary of Present Disclosure

An objective of the present disclosure is to provide a power machine tool, and the power body is able to rotate relative to the housing via the arrangement of the bearing set, such that the power body is under the reverse rotation state when the predefined torque is exceeded. In addition, the torque sensor is able to transmit signal to the control board to stop the running of the power body, thereby preventing the situations of damages of the power device or reduction of useful life.

To achieve the aforementioned objective, the present disclosure provides a power machine tool. A housing includes an accommodating space and a working end located on a front end of the accommodating space. The working end includes an opening. A control board is disposed in the accommodating space. A power device is disposed in the accommodating space, and the power device includes a power body electrically connected to the control board, a driving axle driven by the power body, and a protective cover configured to cover the power body. A bearing set is arranged between the protective cover and the housing to make the power body rotate relative to the housing. A transmission mechanism is disposed in the accommodating space and located on a front side of the power device. The transmission mechanism includes an actuating portion. The actuating portion rotates with the driving axle and is extended out of the opening of the housing to drive a tool piece to rotate. A torque axle is disposed in the accommodating space and located on a rear side of the power device opposite to the transmission mechanism. The torque axle is connected to the power device and configured to rotate with the power device.

An objective of the present disclosure is to provide a torque display structure for a power machine tool. The torque sensor is arranged on a rear side of the power device, such that the torque detection is not affected by the vibration of the external tool piece, thereby providing an accurate torque value.

To achieve the aforementioned objective, the present disclosure provides a torque display structure for a power machine tool, including a power machine tool and a torque sensor. The torque sensor is arranged in the housing and located on a rear side of the power device.

In comparison to the related art, a power machine tool of the present disclosure includes a bearing set arranged between the power body and the housing such that once the predefined torque is exceeded, the power body is able to perform rotation relative to the housing and to be in a reverse rotation state. At the time, the torque sensor is able to transmit signal to the control board to stop the running of the power body, thereby preventing damages of the power device or reduction of useful life. Furthermore, the present disclosure further provides a torque display structure for a power machine tool, and the torque sensor is arranged on a rear side of the power device, such that the torque detection is not affected by the vibration of the external tool piece or any deformation, thereby providing an accurate torque value. Moreover, the arrangement of the torque sensor on the rear end of the housing of the power machine tool is able to further reduce the space on the front end of the housing and to prevent impacts on the power output. Accordingly, the power output may be transmitted to the working end more directly, thereby enhancing the practical use and application.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
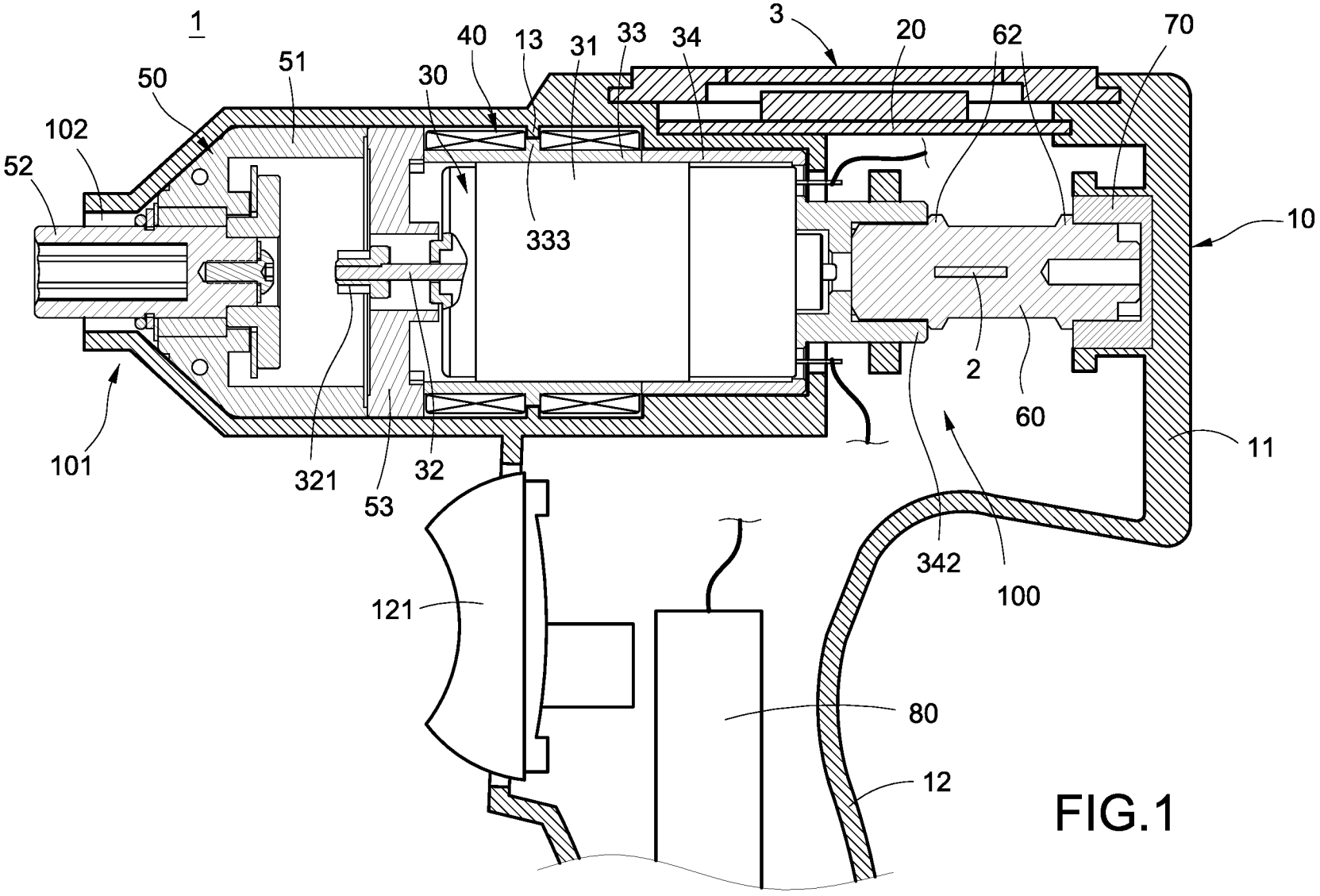
FIG. 1 is a cross sectional view showing a combination of the power machine tool and the torque display structure of the present disclosure.

Please refer to FIG. 1 showing a cross sectional view of a combination of the power machine tool and the torque display structure of the present disclosure. The power machine tool 1 of the present disclosure includes a housing 10 and a control board 20, a power device 30, a bearing set 40, a transmission mechanism 50 and a torque axle 60 disposed in the housing 10. The power device 30 is disposed in the housing 10 via the bearing set 40 and transmits a torque to a tool piece (not shown in the drawings) via the transmission of the transmission mechanism 50. The torque axle 60 is connected to the rear side of the power device 30 and rotates with the power device 30 to constitute the power machine tool 1. For further details of the structure of the power machine tool 1, please refer to the following description.

The housing 10 includes an accommodating space 100 and a working end 101 located on a front end of the receiving space 100. The working end 101 includes an opening 102 connected to the external. The control board 20 is electrically connected to the power device 30 to control the operation of the power machine tool 1.

The power device 30 is disposed in the accommodating space 100. The power device 30 includes a power body 31 electrically connected to the control board 20, a driving axle 32 driven by the power body 31, a protective cover 33 covering the power body 31, and a driving gear 321 attached to the driving axle 32. The driving gear 321 is connected to the transmission mechanism 50.

In an exemplary embodiment, the power body 31 is an electric motor and uses a battery as the power source. The electric motor is used to drive the driving axle 32 to rotate. During actual implementation in practice, the power body 31 may also be an air motor using a compressed air as the power source such that a high-pressure air may be used to drive the driving axle 32 to rotate.

In addition, the bearing set 40 is arranged between the protective cover 33 and the housing 10 to make the power body 31 (together with the protective cover 33) rotate relative to the housing 10.

In addition, the transmission mechanism 50 is disposed in the accommodating space 100 and is located on a front side of the power device 30. The transmission mechanism 50 includes an actuating portion 52. The actuating portion 52 rotates with the driving axle 32 and is extended out of the opening 102 of the housing to drive the tool piece (not shown in the drawings) to rotate. In addition, the torque axle 60 is disposed in the accommodating space 100 and is located on a rear side of the power device 30 opposite to the transmission mechanism 50. Furthermore, the torque axle 60 is connected to the power device 30 and is configured to rotate with the power device 30.

In an exemplary embodiment, the power body 31 is an electric motor. In addition, the transmission mechanism 50 includes a gearbox 51 connected to the driving axle 32. The actuating portion 52 is connected to the gearbox 51 to perform rotational output.

Moreover, the housing 10 includes a body portion 11 and a handle portion 12 connected to the body portion 11. The power device 30 and the transmission mechanism 50 are arranged on the body portion 11. The handle portion 12 includes a button 121 arranged to be exposed from the housing. In addition, in an exemplary embodiment, the power machine tool 1 further includes a battery 80. The battery 80 is arranged on the handle portion 12 and is electrically connected to the control board 20 to provide a power necessary for the operation of the power machine tool 1.

It shall be noted that during actual implementation in practice, the torque axle 60 may also be arranged on the rear side edge of the power device 30, such as on the rear end of the power body 21 and adjacent to one side edge of the battery 80 or the button 121.

Furthermore, the present disclosure further provides a torque display structure (arrangement) for a power machine tool, including the power machine tool 1 and a torque sensor 2. The torque sensor 2 may be a strain gauge disposed in the accommodating space 100 and located on the rear side of the power device 30. In an exemplary embodiment, the torque sensor 2 is arranged on the torque axle 60 and provided to detect a torque of the power machine tool 1. During the actual implementation in practice, the torque sensor 2 may also be arranged on a sleeve 342 or a rear receiving seat 70 as described in the following.

It shall be noted that the power machine tool 1 of the present disclosure further includes a display unit 3. The display unit 3 is exposed from the housing 10 and is electrically connected to the control board 20, and is used to display a torque value of the power machine tool 1.

Figure 2:
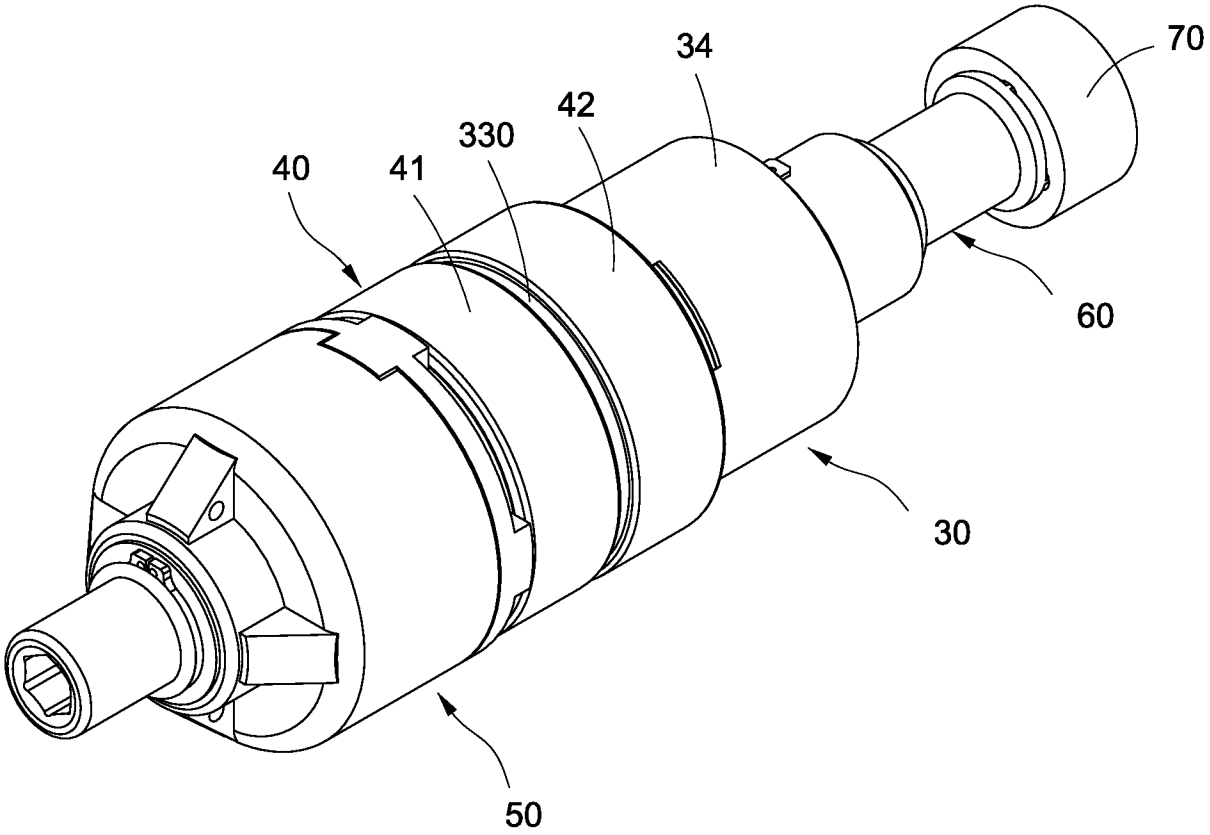
FIG. 2 is a perspective appearance view of the transmission part of the present disclosure.
Figure 3:
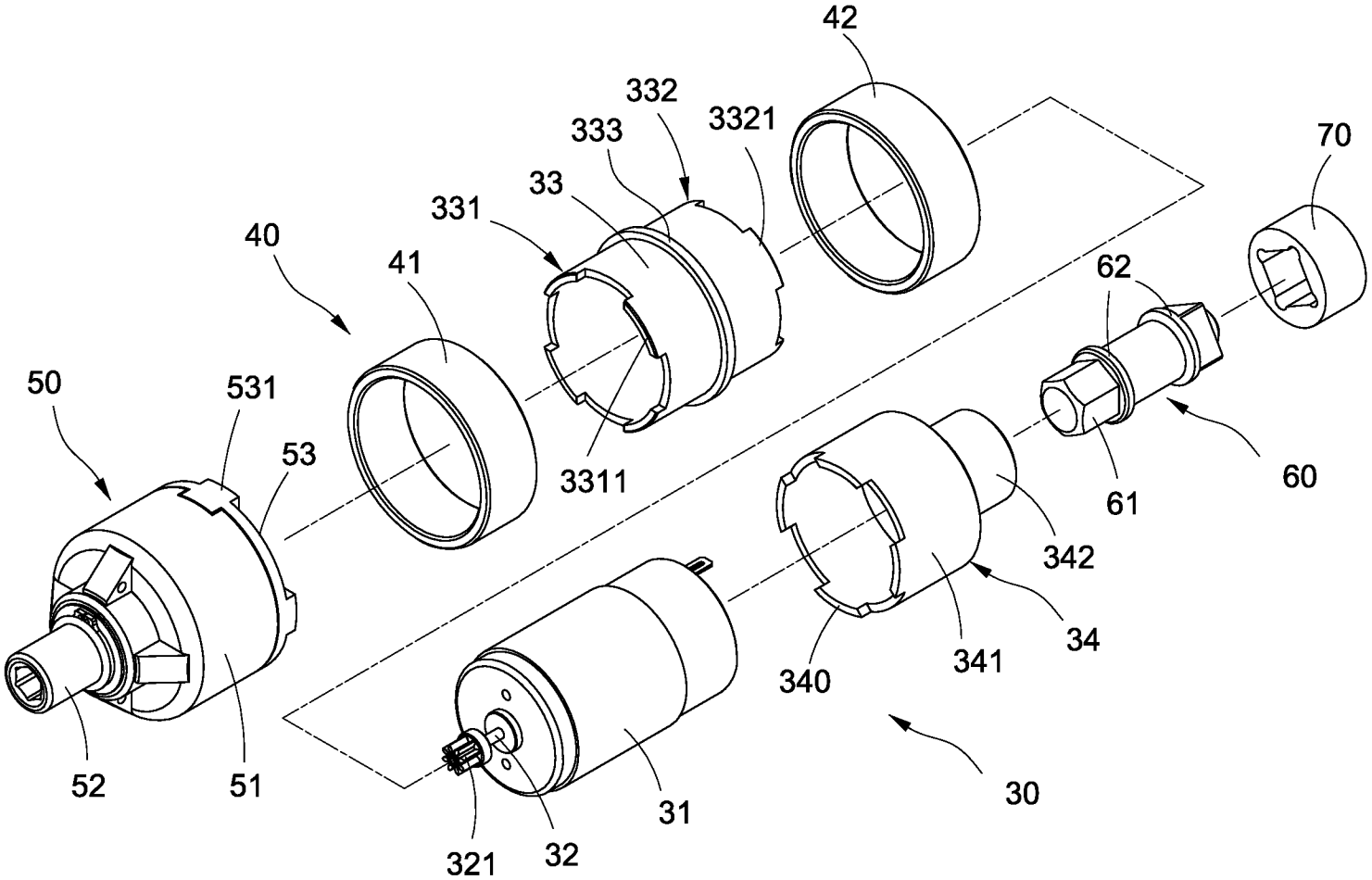
FIG. 3 is a perspective exploded view of the transmission part of the present disclosure viewed from one direction.
Figure 4:
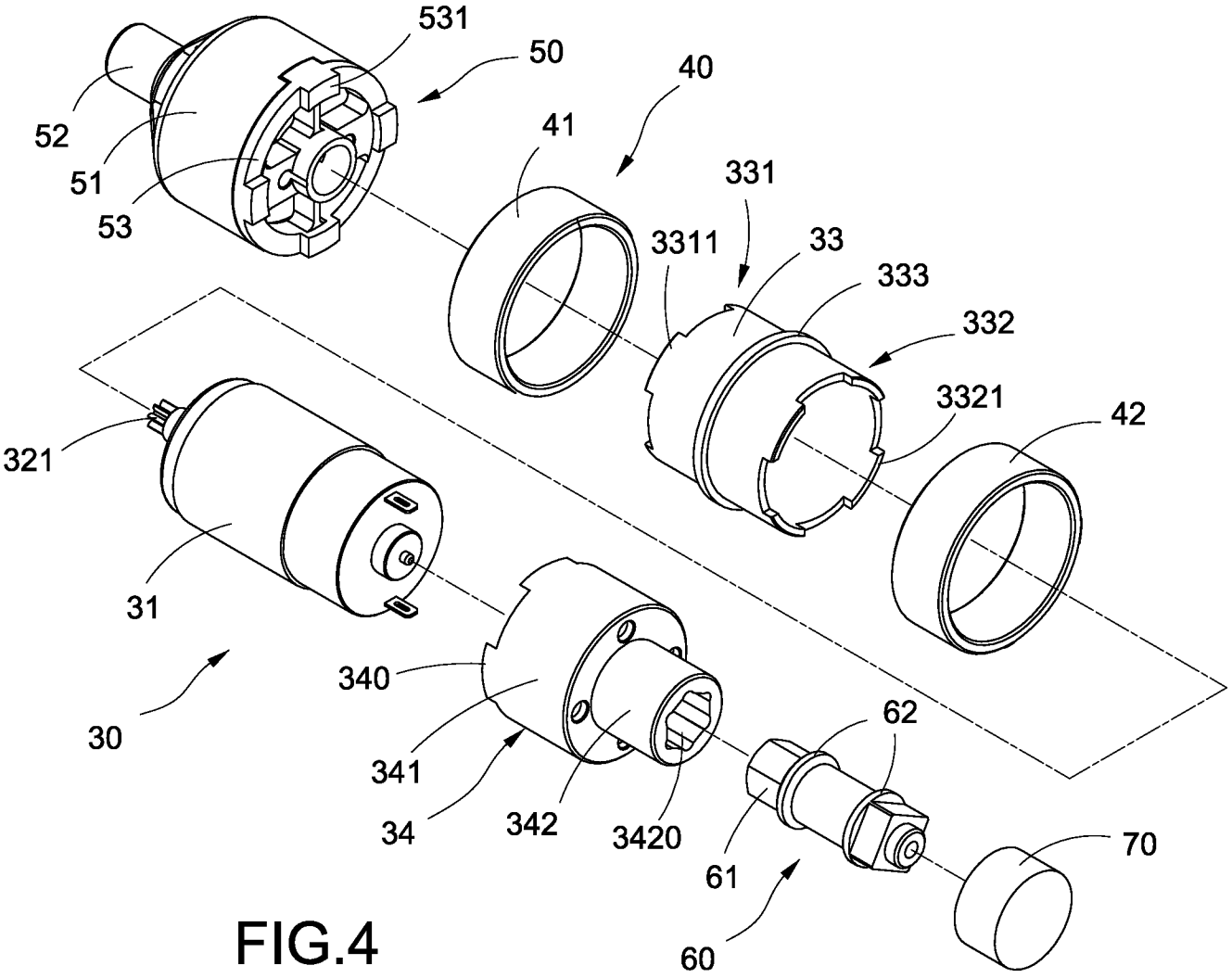
FIG. 4 is another perspective exploded view of the transmission part of the present disclosure viewed from another direction.

Please refer to FIG. 2 to FIG. 4, showing the perspective appearance view and the exploded views of the transmission part of the present disclosure viewed from two directions. As shown in the drawings, in an exemplary embodiment of the present disclosure, the power device 30 further includes a linkage cover 34 arranged between the protective cover 33 and the torque axle 60. In other words, two sides of the linkage cover 34 are connected to the protective cover 33 and the torque axle 60 respectively.

As shown in FIG. 3 and FIG. 4, to be more specific, the protective cover 33 includes a front side 331 and a rear side 332 opposite from each other. The front side 331 includes a plurality of first ratchets 3311 formed thereon, and the rear side 332 includes a plurality of second ratchets 3321 formed thereon. The linkage cover 34 includes a plurality of third ratchets 340 formed on one side thereof facing the protective cover 33 and engaged with the second ratchets 3321. In addition, the linkage cover 34 includes a cover shield 341 and a sleeve 342 connected to the cover shield 341. The cover shield 341 covers a rear side of the power body 31 and includes the plurality of third ratchets 340 formed thereon. The sleeve 342 covers a front end of the torque axle 60. In an exemplary embodiment, the sleeve 342 is formed of a hexagonal hole 3420 thereon (as shown in FIG. 4), and the front end of the torque axle 60 includes a hexagonal column 62 formed thereon. The torque axle 60 penetrates the hexagonal hole 3420 through the hexagonal column 61 to be attached in the sleeve 342.

In an exemplary embodiment, the power machine tool 1 further includes a rear receiving seat 70. The rear receiving seat 70 is secured in the housing 1 (as shown in FIG. 1) and is configured to receive a rear end of the torque axle 60. To be more specific, an outer circumferential surface of the torque axle 60 includes two protruding rings 62 formed spaced apart from each other. The two protruding rings 62 abut against the sleeve 342 and the rear receiving seat 70 respectively. Accordingly, the torque axle 60 is supported between the linkage cover 34 and the rear receiving seat 70.

Furthermore, in an exemplary embodiment of the present disclosure, the transmission mechanism 50 further includes a connecting ring 53. The connecting ring 53 includes a plurality of protrusions 531 formed spaced apart from each other, and the plurality of protrusions 531 are fastened on the first ratchets 3311.

It shall be noted that the bearing set 40 disposed between the protective cover 33 and the housing 10 includes a front bearing 41 and a rear bearing 42 arranged spaced apart from each other. An outer circumferential surface of the protective cover 33 includes a first circumferential rib 333 formed thereon. The front bearing 41 and the rear bearing 42 respectively abut against two sides of the first circumferential rib 333 and are formed with a circumferential slot 330 (as shown in FIG. 2). In addition, an inner wall of the housing 10 includes a second circumferential rib 13 formed thereon (as shown in FIG. 1). The protective cover 33 abuts against the first circumferential rib 333 via the second circumferential rib 13 to be positioned inside the housing 10.

Accordingly, the user is able to press the button 121 to trigger the control board 20 to start the operation. The control board 20 drives the power body 31 to start running. In addition, the power body 31 drives the transmission mechanism 50 to rotate via the driving axle 32. Once the power body 31 reaches a predefined torque, the actuating portion 52 of the transmission 50 then drives the external tool piece to rotate. Subsequently, if the predefined torque is exceeded, the power body 31 is able to utilize the bearing set 40 to perform rotation relative to the housing 10. At the time, the linkage cover 34 and the torque axle 60 are able to rotate together with the power body 31. Furthermore, the torque sensor 2 arranged on the rear side of the power body 31 is able to detect the torque, and such torque signal is transmitted by the control board 20 and displayed on the display unit 3.

It shall be noted that when the power body 31 of the present disclosure exceeds the predefined torque, the power body 31 is under a reverse rotation state, and the torque is transmitted to the torque axle 60. At the time, the torque sensor 2 is able to transmit signal to the control board to immediately stop the running of the power body 31. Furthermore, the torque sensor 2 of the present disclosure is arranged on the rear side of the power device 31, such that the torque detection is not affected by the vibration of the external tool piece, and it is able to provide an accurate torque value. Moreover, the arrangement of the torque sensor 2 on the rear end of the housing 10 of the power machine tool 1 is able to further reduce the space at the front end of the housing 10 and to prevent impacts on the power output. Accordingly, the power output may be transmitted to the working end 101 more directly.

The above description is provided to illustrate the exemplary embodiments of the present disclosure only such that it shall not be treated as limitation to the claimed scope of the present disclosure. In addition, any equivalent modification made based on the present disclosure shall be considered to be within the claimed scope of the present disclosure.

What is claimed is:

1. A power machine tool, comprising:

a housing, comprising an accommodating space and a working end located on a front end of the accommodating space, the working end comprising an opening;

a control board, disposed in the accommodating space;

a power device, disposed in the accommodating space and comprising a power body electrically connected to the control board, a driving axle driven by the power body, and a protective cover covering the power body;

a bearing set, arranged between the protective cover and the housing to make the power body rotate relative to the housing;

a transmission mechanism, disposed in the accommodating space and located on a front side of the power device, and comprising an actuating portion rotating with the driving axle and extended out of the opening of the housing to drive a tool piece to rotate; and a torque axle, disposed in the accommodating space and arranged on a rear side of the power device, and connected to and rotate with the power device, wherein the power device further comprises a linkage cover arranged between the protective cover and the torque axle, two sides of the linkage cover are connected to the protective cover and the torque axle, respectively.

2. The power machine tool according to claim 1, wherein the protective cover comprises a front side and a rear side opposite from each other, the front side comprises a plurality of first ratchets, and the rear side comprises a plurality of second ratchets, the linkage cover comprises a plurality of third ratchets disposed on one side thereof facing the protective cover and engaged with the second ratchets.

3. The power machine tool according to claim 2, wherein the linkage cover comprises a cover shield and a sleeve connected to the cover shield, the cover shield covers a rear side of the power body and comprises the plurality of third ratchets disposed thereon, the sleeve covers a front end of the torque axle.

4. The power machine tool according to claim 3, further comprising: a rear receiving seat, secured in the housing and receiving a rear end of the torque axle.

5. The power machine tool according to claim 4, wherein the torque axle comprises two protruding rings disposed spacedly on an outer circumferential surface thereof, the two protruding rings abut against the sleeve and the rear receiving seat respectively.

6. The power machine tool according to claim 2, wherein the transmission mechanism further comprises a connecting ring, the connecting ring comprises a plurality of protrusions disposed spacedly, and the protrusions are fastened to the first ratchets.

7. The power machine tool according to claim 1, wherein the bearing set comprises a front bearing and a rear bearing, the protective cover comprises a first circumferential rib disposed on an outer circumferential surface thereof, the front bearing and the rear bearing respectively abut against two sides of the first circumferential rib to configure a circumferential slot, the housing comprises a second circumferential rib disposed on an inner wall thereof, the protective cover abuts against the first circumferential rib via the second circumferential rib to be positioned in the housing.

8. The power machine tool according to claim 1, further comprising a torque sensor; the torque sensor arranged in the housing and located on a rear side of the power device.

9. The power machine tool according to claim 8, wherein the torque sensor is arranged on the torque axle.

* * * * *